US011100849B1

(12) United States Patent
Yang et al.

(10) Patent No.: US 11,100,849 B1
(45) Date of Patent: Aug. 24, 2021

(54) DISPLAY DEVICE AND DRIVING METHOD THEREOF

(71) Applicant: SHENZHEN CHINA STAR OPTOELECTRONICS SEMICONDUCTOR DISPLAY TECHNOLOGY CO., LTD., Shenzhen (CN)

(72) Inventors: Bo Yang, Guangdong (CN); Taijiun Hwang, Guangdong (CN); Pengfei Liang, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/962,046

(22) PCT Filed: May 20, 2020

(86) PCT No.: PCT/CN2020/091298

§ 371 (c)(1),
(2) Date: Jul. 14, 2020

(30) Foreign Application Priority Data

May 13, 2020 (CN) ..... 202010403864.3

(51) Int. Cl.
*G09G 3/32* (2016.01)

(52) U.S. Cl.
CPC ..... *G09G 3/32* (2013.01); *G09G 2310/027* (2013.01); *G09G 2310/0267* (2013.01); *G09G 2310/08* (2013.01)

(58) Field of Classification Search
CPC ..... G09G 2310/08; G09G 2310/027; G09G 3/32; G09G 2310/0267
See application file for complete search history.

(56) References Cited

U.S. PATENT DOCUMENTS

| | | | | |
|---|---|---|---|---|
| 2002/0140659 | A1 | 10/2002 | Mikami | |
| 2008/0309597 | A1 | 12/2008 | Nam et al. | |
| 2011/0242082 | A1 | 10/2011 | Kojima | |
| 2018/0293929 | A1* | 10/2018 | Shigeta | G09G 3/2011 |
| 2018/0301080 | A1 | 10/2018 | Shigeta et al. | |
| 2019/0371231 | A1 | 12/2019 | Kim et al. | |
| 2019/0371232 | A1* | 12/2019 | Kim | G09G 3/32 |
| 2020/0111404 | A1* | 4/2020 | Kim | G09G 3/2003 |

FOREIGN PATENT DOCUMENTS

| | | | |
|---|---|---|---|
| CN | 101202022 | A | 6/2008 |
| CN | 101329851 | A | 12/2008 |
| CN | 108735143 | A | 11/2018 |
| CN | 109979378 | A | 7/2019 |
| CN | 110556072 | A | 12/2019 |
| CN | 110782831 | A | 2/2020 |

* cited by examiner

*Primary Examiner* — Muhammad N Edun

(57) ABSTRACT

The present application provides a display device and a driving method of the display device. A pixel circuit controls a light-emitting duration of a light-emitting element according to a pulse width modulation scan signal, a pulse width modulation data signal, and a pulse width modulation control signal, and controls an amount of a driving current of the light-emitting element according to a pulse amplitude modulation scan signal and a pulse amplitude modulation data signal.

16 Claims, 5 Drawing Sheets

DISPLAY DEVICE AND DRIVING METHOD THEREOF

FIELD OF DISCLOSURE

The present application relates to display technology and in particular to a display device and a driving method thereof.

DESCRIPTION OF RELATED ART

Referring to FIG. 1, it is a 3T1C driving circuit for driving inorganic light-emitting diodes by conventional pulse-width modulation (PWM), where Scan1 is a charge scan signal, Vdata is a charge data signal, and Scan2 is a discharge scan signal, Vini is a reference voltage signal, T1 is a charging transistor, T2 is a discharging transistor, T3 is a driving transistor, Cst is a storage capacitor, LED is an inorganic light-emitting diode, OVDD is a high level end, and OVSS is a low level end. When the driving circuit shown in FIG. 1 is in operation, the charging transistor T1 charges a voltage at a point g, and the discharging transistor T2 discharges the voltage at the point g, and grayscales are generated by a pulse width modulation method.

Referring to FIG. 2, it is a driving timing diagram of the driving circuit of FIG. 1 using the conventional pulse-width modulation. By controlling a charging time of a sub-field, combined with a principle that the human eye's perception of brightness is an integral over time, digital voltages are used to display different grayscale brightness images. An oblique line 1 is a charging and scanning process of pixels (the charging transistor T1) for each sub-field, an oblique line 2 is a discharging and scanning process for each sub-field (the discharging transistor T2), a blank area is a process of lighting a corresponding sub-pixel (turning on the driving transistor T3), and a shaded area is a process of turning off the pixel (turning off the driving transistor T3).

However, the conventional pulse-width modulation has problems like short charging time, high requirements for data transmission bandwidth, and failing to support high resolution.

SUMMARY

It is an objective of the present application to provide a display device and a driving method thereof, which can eliminate color shifts, and has advantages like long sub-pixel charging time, general requirements for data transmission bandwidth, and support for high resolution.

Accordingly, the present application provides a display device, the display device comprising:

a timing controller, a plurality of first gate driving units, a plurality of second gate driving units, a first source driving unit, a second source driving unit, and a display panel, wherein the display panel comprises a plurality of sub-pixels, and each of the sub-pixels comprises a pixel circuit and a light-emitting element electrically connected to the pixel circuit, wherein the timing controller is electrically connected to the first gate driving units, the second gate driving units, and the first source driving unit, and the timing controller is configured to receive an image grayscale data and convert the image grayscale data to a first timing control signal and a third timing control signal and is also configured to output a second timing control signal;

the first gate driving units are electrically connected to the pixel circuits, configured to receive the first timing control signal, and configured to output a pulse width modulation scan signal according to the first timing control signal;

the second gate driving units are electrically connected to the pixel circuits, configured to receive the second timing control signal, and configured to output a pulse amplitude modulation scan signal according to the second timing control signal;

the first source driving unit is electrically connected to the pixel circuits, configured to receive the third timing control signal, and configured to output the pulse width modulation data signal according to the third timing control signal;

the second source driving unit is electrically connected to the pixel circuits and configured to output a pulse amplitude modulation data signal; and the pixel circuit is configured to control a light-emitting duration of the light-emitting element according to the pulse width modulation scan signal, the pulse width modulation data signal, and a pulse width modulation control signal, and the pixel circuit is configured to control an amount of a driving current of the light-emitting element according to the pulse amplitude modulation scan signal and the pulse amplitude modulation data signal.

In the display device, the timing controller comprises a first conversion unit, a second conversion unit, and a third conversion unit;

the first conversion unit is configured to receive the image grayscale data and convert the image grayscale data into a brightness data according to a stored data relating to a mapping relationship between grayscale and brightness;

the second conversion unit is configured to receive the brightness data and convert the brightness data into a light-emitting time data according to a stored data relating to a mapping relationship between brightness and light-emitting time; and the third conversion unit is configured to receive the light-emitting time data and convert the light-emitting time data into the first timing control signal and the third timing control signal.

In the display device, the display panel comprises a plurality of first scan lines arranged parallel to each other along a first direction for transmitting the pulse width modulation scan signal, a plurality of second scan lines arranged parallel to each other along the first direction for transmitting the pulse amplitude modulation scan signal, a plurality of first data lines arranged parallel to each other along a second direction for transmitting the pulse width modulation data signal, at least one control signal line for transmitting the pulse width modulation control signal, and at least one second data line for transmitting the pulse amplitude modulation data signal;

the first gate driving units are electrically connected to the first scan lines, the second gate driving units are electrically connected to the second scan lines, the first source driving unit is connected to the first data lines, and the second source driving unit is electrically connected to the at least one second data line; and each of the sub-pixels is electrically connected to one of the first scan lines, one of the second scan lines, one of the first data lines, one of the at least one second data line, and one of the least one control signal line.

In the display device, the pixel circuit comprises a pulse width modulation unit and a pulse amplitude modulation unit;

the pulse width modulation unit is configured to control the light-emitting duration of the light-emitting element according to the pulse width modulation scan signal, the pulse width modulation data signal, and the pulse width modulation control signal; and the pulse amplitude modulation unit is configured to control the amount of the driving current of the light-emitting element according to the pulse amplitude modulation scan signal and the pulse amplitude modulation data signal.

In the display device, the pixel circuit further comprises a driving unit;

the pulse width modulation unit is configured to output a light-emitting duration control signal according to the pulse width modulation scan signal, the pulse width modulation data signal, and the pulse width modulation control signal;

the pulse amplitude modulation unit is configured to output an amplitude control signal according to the pulse amplitude modulation scan signal and the pulse amplitude modulation data signal; and the driving unit is configured to control the amount of the driving current of the light-emitting element according to the amplitude control signal and control the light-emitting duration of the light-emitting element according to the light-emitting duration control signal.

In the display device, the pulse width modulation unit comprises a first control unit, a comparison unit, and a second control unit;

the first control unit is configured to output a first voltage according to the pulse width modulation control signal and a reference voltage signal;

the second control unit is configured to output a second voltage according to the pulse width modulation scan signal and the pulse width modulation data signal; and the comparison unit is configured to compare the first voltage and the second voltage to output the light-emitting duration control signal.

In the display device, the first control unit has a reference voltage input end, a pulse width modulation control signal input end, and a first voltage output end, the first control unit comprises a first thin film transistor (TFT), a first capacitor, and a resistor; a first end of the first TFT is connected to the reference voltage input end, a second end of the first TFT is connected to the first voltage output end, and a control end of the first TFT is connected to the pulse width modulation control signal input end; one end of the first capacitor is connected to the first voltage output end, another end of the first capacitor is connected to a ground end, one end of the resistor is connected to the first voltage output end, and another end of the resistor is connected to the ground end;

the second control unit has a pulse width modulation scan signal input end, a pulse width modulation data signal input end, and a second voltage output end, the second control unit comprises a second TFT, a first end of the second TFT is connected to the pulse width modulation data signal input end, a second end of the second TFT is connected to the second voltage output end, and a control end of the second TFT is connected to the pulse width modulation scan signal input end; and the comparison unit is connected to a first level output end, a second level output end, the ground end, and a light-emitting duration control signal output end, the comparison unit comprises a voltage comparator and a second capacitor, a negative input end of the voltage comparator is connected to the first level output end, a positive input end of the voltage comparator is connected to the second level output end, an output end of the voltage comparator is connected to the light-emitting duration control signal output end, one end of the second capacitor is connected to the second level output end, and another end of the second capacitor is connected to the ground end.

In the display device, the comparison unit further comprises a voltage follower, a positive input end of the voltage follower is connected to the second level output end, a negative input end and an output end of the voltage follower are connected to the positive input end of the voltage comparator, and the negative input end of the voltage follower is connected to the output end of the voltage follower.

In the display device, the driving unit comprises a third TFT, a driving transistor, and a third capacitor, a control end of the third TFT is connected to a light-emitting duration control signal output end, a first end of the third TFT is connected to a ground end, a second end of the third TFT is connected to a control end of the driving transistor, one end of the third capacitor is connected to the control end of the driving transistor, and another end of the third capacitor is connected to a second end of the driving transistor, a first end of the driving transistor is connected to a first end of the light-emitting element, the second end of the driving transistor is connected to a second level end, a second end of the light-emitting element is connected to a first level end; and the pulse amplitude modulation unit comprises a fourth TFT, a first end of the fourth TFT is connected to a pulse amplitude modulation data signal input end, a second end of the fourth TFT is connected to an amplitude control signal output end, and a control end of the fourth TFT is connected to a pulse amplitude modulation scan signal input end.

The present application provides a driving method of a display device, wherein the display device comprises a timing controller, a plurality of first gate driving units, a plurality of second gate driving units, a first source driving unit, a second source driving unit, and a display panel; the display panel comprises a plurality of sub-pixels, and each of the sub-pixels comprises a pixel circuit and a light-emitting element electrically connected to the pixel circuit; the timing controller is electrically connected to the first gate driving units, the second gate driving units, and the first source driving unit; and the first gate driving units, the second gate driving units, the first source driving unit, and the second source driving unit are electrically connected to the pixel circuits, wherein the driving method comprises following steps:

the timing controller receiving an image grayscale data, converting the image grayscale data to a first timing control signal and a third timing control signal, and outputting a second timing control signal;

the first gate driving unit receiving the first timing control signal and outputting a pulse width modulation scan signal according to the first timing control signal; the first source driving unit receiving the third timing control signal and outputting a pulse width modulation data signal according to the third timing control signal; the second gate driving unit receiving the second timing control signal and outputting a pulse amplitude modulation scan signal according to the second timing control signal; and the second source driving unit outputting a pulse amplitude modulation data signal; and the pixel circuit controlling a light-emitting duration of the light-emitting element according to the pulse width modulation scan signal, the pulse width modulation data signal, and a pulse width modulation control signal, and controlling an amount of a driving current of the light-emitting element according to the pulse amplitude modulation scan signal and the pulse amplitude modulation data signal.

In the driving method of the display device, the timing controller comprises a first conversion unit, a second conversion unit, and a third conversion unit;

the first conversion unit is configured to receive the image grayscale data and convert the image grayscale data into a brightness data according to a stored data relating to a mapping relationship between grayscale and brightness;

the second conversion unit is configured to receive the brightness data and convert the brightness data into a light-emitting time data according to a stored data relating to a mapping relationship between brightness and light-emitting time; and the third conversion unit is configured to receive the light-emitting time data and convert the light-emitting time data into the first timing control signal and the third timing control signal.

In the driving method of the display device, the display panel comprises a plurality of first scan lines arranged parallel to each other along a first direction for transmitting the pulse width modulation scan signal, a plurality of second scan lines arranged parallel to each other along the first direction for the transmitting the pulse amplitude modulation scan signal, a plurality of first data lines arranged parallel to each other along a second direction for transmitting the pulse width modulation data signal, at least one control signal line for transmitting the pulse width modulation control signal, and at least one second data line for transmitting the pulse amplitude modulation data signal;

the first gate driving units are electrically connected to the first scan lines, the second gate driving units are electrically connected to the second scan lines, the first source driving unit is connected to the first data lines, and the second source driving unit is electrically connected to the at least one second data line; and each of the sub-pixels is electrically connected to one of the first scan lines, one of the second scan lines, one of the first data lines, one of the at least one second data line, and one of the at least one control signal line.

In the driving method of the display device, the pixel circuit comprises a pulse width modulation unit and a pulse amplitude modulation unit;

the pulse width modulation unit is configured to control the light-emitting duration of the light-emitting element according to the pulse width modulation scan signal, the pulse width modulation data signal, and the pulse width modulation control signal; and the pulse amplitude modulation unit is configured to control the amount of the driving current of the light-emitting element according to the pulse amplitude modulation scan signal and the pulse amplitude modulation data signal.

In the driving method of the display device, the pixel circuit further comprises a driving unit;

the pulse width modulation unit is configured to output a light-emitting duration control signal according to the pulse width modulation scan signal, the pulse width modulation data signal, and the pulse width modulation control signal;

the pulse amplitude modulation unit is configured to output an amplitude control signal according to the pulse amplitude modulation scan signal and the pulse amplitude modulation data signal; and the driving unit is configured to control the amount of the driving current of the light-emitting element according to the amplitude control signal and control the light-emitting duration of the light-emitting element according to the light-emitting duration control signal.

In the driving method of the display device, the pulse width modulation unit comprises a first control unit, a comparison unit, and a second control unit;

the first control unit is configured to output a first voltage according to the pulse width modulation control signal and a reference voltage signal;

the second control unit is configured to output a second voltage according to the pulse width modulation scan signal and the pulse width modulation data signal; and the comparison unit is configured to compare the first voltage and the second voltage to output the light-emitting duration control signal.

In the driving method of the display device, the first control unit has a reference voltage input end, a pulse width modulation control signal input end, and a first voltage output end; the first control unit comprises a first thin film transistor (TFT), a first capacitor, and a resistor; a first end of the first TFT is connected to the reference voltage input end, a second end of the first TFT is connected to the first voltage output end, a control end of the first TFT is connected to the pulse width modulation control signal input end, one end of the first capacitor is connected to the first voltage output end, another end of the first capacitor is connected to a ground end, one end of the resistor is connected to the first voltage output end, and another end of the resistor is connected to the ground end;

the second control unit comprises a pulse width modulation scan signal input end, a pulse width modulation data signal input end, and a second voltage output end, the second control unit comprises a second TFT, a first end of the second TFT is connected to the pulse width modulation data signal input end, a second end of the second TFT is connected to the second voltage output end, and a control end of the second TFT is connected to the pulse width modulation scan signal input end; and the comparison unit is connected to a first level output end, a second level output end, the ground end, and a light-emitting duration control signal output end, the comparison unit comprises a voltage comparator and a second capacitor, a negative input end of the voltage comparator is connected to the first level output end, a positive input end of the voltage comparator is connected to the second level output end, an output end of the voltage comparator is connected to the light-emitting duration control signal output end, one end of the second capacitor is connected to the second level output end, and another end of the second capacitor is connected to the ground end.

In the driving method of the display device, the comparison unit further comprises a voltage follower, a positive input end of the voltage follower is connected to the second level output end, a negative input end and an output end of the voltage follower are connected to the positive input end of the voltage comparator, and the negative input end of the voltage follower is connected to the output end of the voltage follower.

In the driving method of the display device, the driving unit comprises a third TFT, a driving transistor, and a third capacitor, a control end of the third TFT is connected to a light-emitting duration control signal output end, a first end of the third TFT is connected to a ground end, a second end of the third TFT is connected to a control end of the driving transistor, one end of the third capacitor is connected to the control end of the driving transistor, another end of the third capacitor is connected to a second end of the driving transistor, a first end of the driving transistor is connected to a first end of the light-emitting element, the second end of the driving transistor is connected to a second level end, a second end of the light-emitting element is connected to a first level end; and the pulse amplitude modulation unit comprises a fourth TFT, a first end of the fourth TFT is connected to a pulse amplitude modulation data signal input end, a second end of the fourth TFT is connected to an amplitude control signal output end, and a control end of the fourth TFT is connected to the pulse amplitude modulation scan signal input end.

ADVANTAGES OF THE PRESENT APPLICATION

The present application provides the display device and the driving method thereof. The timing controller converts the image grayscale data into the first timing control signal that controls the first gate driving unit to output the pulse width modulation scan signal, and the third timing control signal that controls the first source driving unit to output the pulse width modulation data signal. The timing controller outputs the second timing control signal that controls the second gate driving unit to output the pulse amplitude modulation scan signal, the second source driving unit outputs the pulse amplitude modulation data signal, and the pixel circuit is configured to control the light-emitting duration of the light-emitting element according to the pulse width modulation scan signal, the pulse width modulation data signal, and the pulse width modulation control signal, and controls the amount of the driving current of the light-emitting element according to the pulse amplitude modulation scan signal and the pulse amplitude modulation data signal. The present application can avoid color shifts of the conventional pulse amplitude modulation driving. The display device of the present application has advantages like a long charging time of the sub-pixels, general requirements for data transmission bandwidth, and support for high resolution.

BRIEF DESCRIPTION OF DRAWINGS

In order to more clearly illustrate the embodiments of the present disclosure or related art, figures which will be described in the embodiments are briefly introduced hereinafter. It is obvious that the drawings are merely for the purposes of illustrating some embodiments of the present disclosure, and a person having ordinary skill in this field can obtain other figures according to these figures without inventive work.

DETAILED DESCRIPTION OF EMBODIMENTS

Technical solutions of the present application will be described clearly and completely in conjunction with the accompanying drawings and specific embodiments. Obviously, the described embodiments are only some embodiments of the present application, but not all the embodiments. Based on the embodiments in the present application, all other embodiments obtained by those skilled in the art without inventiveness fall within the protection scope of the present application.

Figure 1:
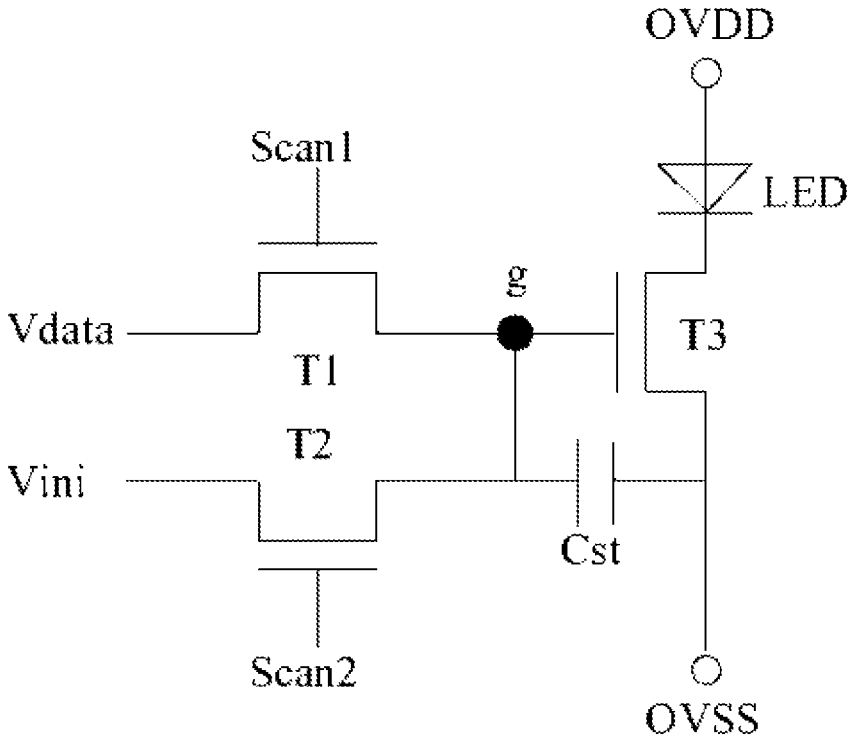
FIG. 1 is a 3T1C driving circuit for driving inorganic light-emitting diodes by conventional pulse-width modulation (PWM)
Figure 2:
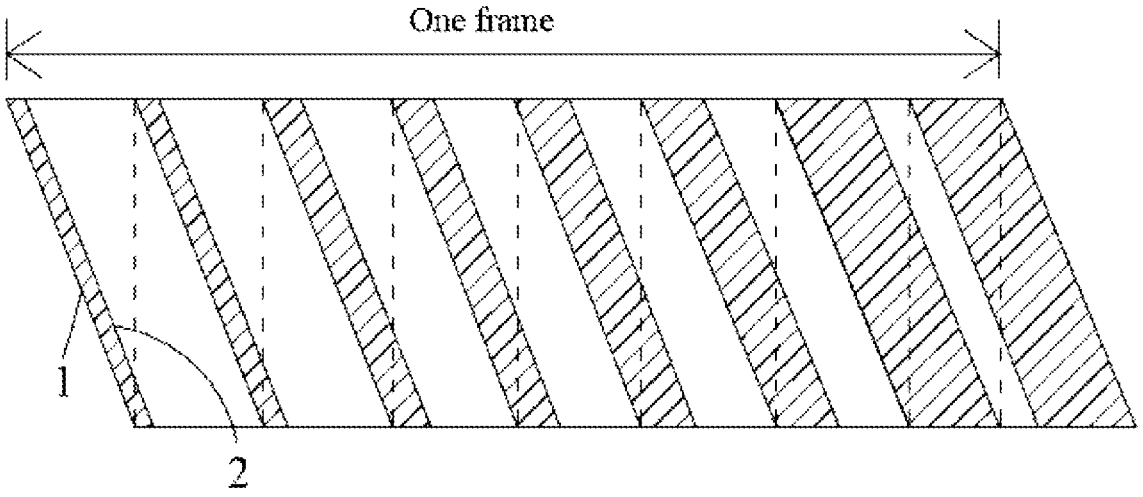
FIG. 2 is a driving timing diagram of the driving circuit of FIG. 1 using the conventional pulse-width modulation.
Figure 3:
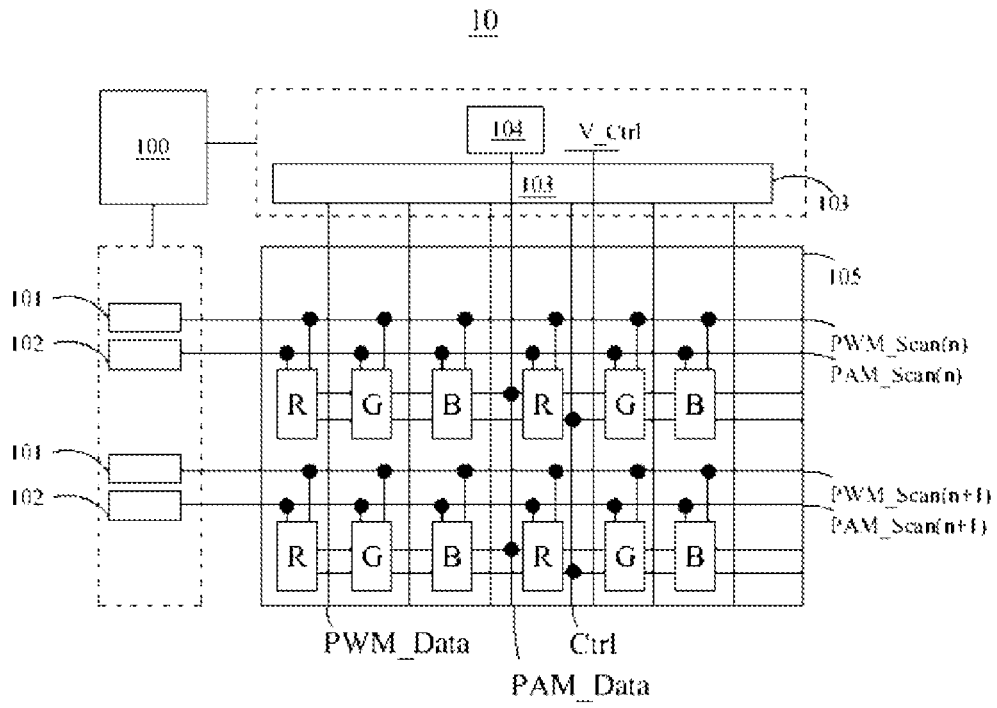
FIG. 3 is a schematic diagram illustrating a display device according to one embodiment of the present application.

Please refer to FIG. 3, which is a schematic view illustrating a display device according to one embodiment of the present application. The display device 10 comprises a timing controller 100, a plurality of first gate driving units 101, a plurality of second gate driving units 102, a first source driving unit 103, a second source driving unit 104, and a display panel 105. The timing controller 100 is electrically connected to the first gate driving units 101, the second gate driving units 102, and the first source driving unit 103.

In a display region, the display panel 105 comprises a plurality of first scan lines PWM_Scan arranged parallel to each other along a first direction for transmitting a pulse width modulation scan signal, a plurality of second scan lines PAM_Scan arranged parallel to each other along the first direction for transmitting a pulse amplitude modulation scan signal, a plurality of first data lines PWM_Data arranged parallel to each other along a second direction for transmitting a pulse width modulation data signal, at least one control signal line Ctrl for transmitting a pulse width modulation control signal, and at least one second data line PAM_Data for transmitting a pulse amplitude modulation data signal. The first direction and the second direction are perpendicular to each other. The number of the first scan lines PWM_Scan is the same as the number of the second scan lines PAM_Scan. One first scan line PWM_Scan is arranged adjacent to and corresponding to one second scan line PAM_Scan. The present embodiment has one control signal line Ctrl and one second data line PAM_Data, the control signal line Ctrl is parallel to the first data line PWM_Data, and the second data line PAM_Data is parallel to the first data line PWM_Data.

The display panel 105 comprises a plurality of sub-pixels arranged in an array, and the sub-pixels arranged in an array comprises a red sub-pixel R, a green sub-pixel G, and a blue sub-pixel B. The red sub-pixel R, the green sub-pixel G, and the blue sub-pixel B are repeatedly arranged in the same row in sequence, and the sub-pixels in the same column emit the same color light. For example, the sub-pixels in the same column are red sub-pixels R. Each sub-pixel is electrically connected to one first scan line PWM_Scan, one second scan line PAM_Scan, one first data line PWM_Data, one second data line PAM_Data, and one control signal line Ctrl. Each sub-pixel includes a pixel circuit and a light-emitting element 50 electrically connected to the pixel circuit. The light-emitting element 50 is a miniature light-emitting diode (with a size less than 100 microns) or a sub-millimeter light-emitting diode (with a size of 100 microns to 200 microns).

Specifically, the sub-pixels in the same row are connected to the same first scan line PWM_Scan and the same second scan line PAM_Scan; the sub-pixels in the same column are connected to the same first data line PWM_Data; the sub-pixels in the same row are connected to the second data line PAM_Data through a same branch line of the second data line PAM_Data; and the sub-pixels in the same row are connected to the control signal line Ctrl through a same branch line of the control signal line Ctrl.

The timing controller 100 is configured to receive an image data and a clock signal data, wherein the image data comprises an image grayscale data, and the timing controller 100 converts the image grayscale data into a first timing control signal and a third timing control signal and is also configured to output a second timing control signal.

Figure 4:
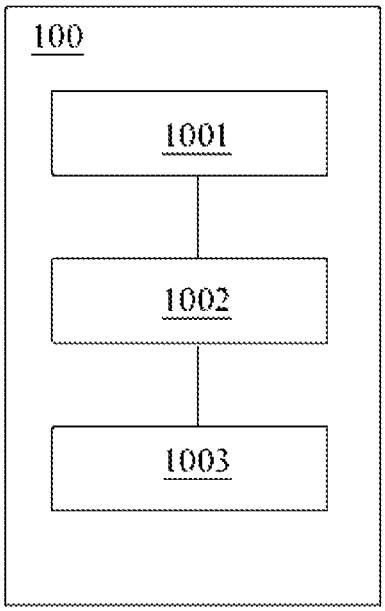
FIG. 4 is a diagram illustrating a timing controller shown in FIG. 3.

Please refer to FIG. 4, which is a diagram illustrating the timing controller shown in FIG. 3. The timing controller 100 comprises a first conversion unit 1001, a second conversion unit 1002, and a third conversion unit 1003. The first conversion unit 1001 is configured to receive the image grayscale data and convert the image grayscale data into a brightness data according to a stored data relating to a mapping relationship between grayscale and brightness. The data relating to the mapping relationship between grayscale and brightness is stored in the first conversion unit 1001.

The second conversion unit 1002 is configured to receive the brightness data and convert the brightness data into a light-emitting time data according to a stored data relating to a mapping relationship between brightness and light-emitting time. The data relating to the mapping relationship between brightness and light-emitting time is stored in the second conversion unit 1002.

The third conversion unit 1003 is configured to receive the light-emitting time data and convert the light-emitting time data into the first timing control signal and the third timing control signal.

The first gate driving units 101 are configured to receive the first timing control signal, and configured to output the pulse width modulation scan signal according to the first timing control signal. The first gate driving units 101 are electrically connected to the first scan lines PWM_Scan, so that the first gate driving unit 101 are electrically connected to the pixel circuits. The first gate driving units 101 transmit the pulse width modulation scan signal to the pixel circuits of the sub-pixels in each row through the first scan lines PWM_Scan. The first scan lines PWM_Scan (including PWM_Scan(n) and PWM_Scan(n+1)) sequentially receive, from top to bottom, the pulse width modulation scan signal.

The second gate driving units 102 are configured to receive a second timing control signal, and output a pulse amplitude modulation scan signal according to the second timing control signal. The second gate driving units 102 are electrically connected to the second scan lines PAM_Scan, so that the second gate driving units 102 are connected to the pixel circuits. The second gate driving units 102 transmit the pulse amplitude modulation scan signal to the pixel circuits of the sub-pixels in each row through the second scan lines PAM_Scan. The second scan lines PAM_Scan (including PAM_Scan(n) and PAM_Scan(n+1)) sequentially receive, from top to bottom, the pulse amplitude modulation scan signal.

The first gate driving unit 101 and the second gate driving unit 102 can be integrated into one gate driving unit, or can be disposed separately. The first gate driving unit 101 and the second gate driving unit 102 can be disposed in a non-display region of the display panel 105, and both of them can be disposed on the same side of the non-display region, or can be disposed on opposite sides of the non-display region, or can be disposed in a one-to-one correspondence on opposite sides of the display region.

The first source driving unit 103 is configured to receive the third timing control signal, and output the pulse width modulation data signal according to the third timing control signal. The first source driving unit 103 is electrically connected to the first data line PWM_Data, so that the first source driving unit 103 is connected to the pixel circuit. The first source driving unit 103 transmits the pulse width modulation data signal to the pixel circuit through the first data line PWM_Data.

The second source driving unit 104 is configured to output a pulse amplitude modulation data signal. The second source driving unit 104 is electrically connected to the second data line PAM_Data, so that the second source driving unit 104 is connected to the pixel circuit. The second source driving unit 104 transmits the pulse amplitude modulation data signal to the pixel circuit through the second data line PAM_Data. The pulse amplitude modulation data signal is a constant reference voltage.

The control signal line Ctrl is connected to a pulse width modulation control signal input end V_Ctrl, and the control signal line Ctrl transmits the pulse width modulation control signal to the pixel circuit.

The first source driving unit 103 and the second source driving unit 104 can be integrated into the same source driving unit. The pulse width modulation control signal input end V_Ctrl can also be integrated with the first source driving unit 103 in the same source driving unit.

The pixel circuit is configured to control a light-emitting duration of the light-emitting element 50 according to the pulse width modulation scan signal, the pulse width modulation data signal, and the pulse width modulation control signal, and to control an amount of a driving current of the light-emitting element 50 according to the pulse amplitude modulation scan signal and the pulse amplitude modulation data signal.

The timing controller of the display device of the present application converts the image grayscale data into the first timing control signal that controls the first gate driving unit to output the pulse width modulation scan signal, and the third timing control signal that controls the first source driving unit to output the pulse width modulation data signal. The timing controller outputs the second timing control signal that controls the second gate driving unit to output the pulse amplitude modulation scan signal, the second source driving unit outputs the pulse amplitude modulation data signal, and the pixel circuit is configured to control the light-emitting duration of the light-emitting element according to the pulse width modulation scan signal, the pulse width modulation data signal, and the pulse width modulation control signal, and controls the amount of the driving current of the light-emitting element according to the pulse amplitude modulation scan signal and the pulse amplitude modulation data signal. Compared with conventional pulse amplitude modulation driving, the present application can avoid color shifts of the conventional pulse amplitude modulation driving. Compared with the conventional pulse width modulation driving, sub-fields are not required, so that the present application has advantages like a long charging time of the sub-pixels, general requirements for data transmission bandwidth because less data need to be transmitted, and support for high resolution. The timing controller converts the image grayscale data into the timing control signals that control the first gate driving unit and the first source driving unit to output the pulse width modulation scan signal and the pulse width modulation data signal, which is beneficial to realize a combination of the pulse width modulation driving and the pulse amplitude modulation.

Figure 5A:
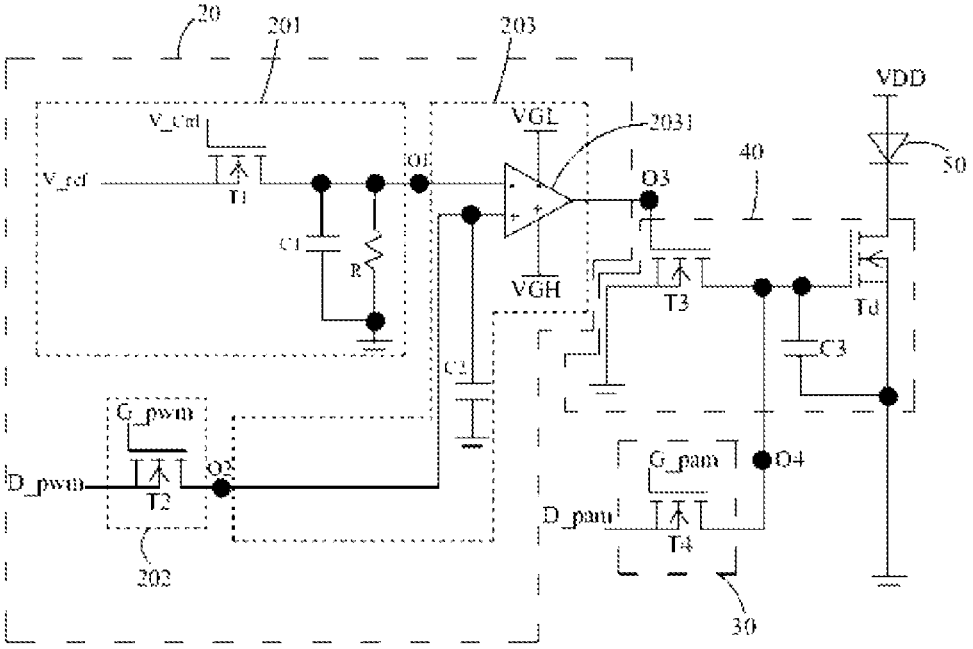
FIG. 5A is a first schematic diagram of a sub-pixel in FIG. 3.

Please refer to FIG. 5A, which is the first schematic diagram of the sub-pixel in FIG. 3. The sub-pixel includes the pixel circuit and the light-emitting element 50. The pixel circuit includes a pulse width modulation unit 20, a pulse amplitude modulation unit 30, and a driving unit 40.

The pulse width modulation unit 20 is configured to control the light-emitting duration of the light-emitting element 50 according to the pulse width modulation scan signal, the pulse width modulation data signal, and the pulse width modulation control signal. The pulse width modulation unit 20 is configured to output a light-emitting duration control signal according to the pulse width modulation scan signal, the pulse width modulation data signal, and the pulse width modulation control signal. The pulse width modulation unit 20 comprises a first control unit 201, a comparison unit 203, and a second control unit 202.

The first control unit 201 is configured to output a first voltage according to the pulse width modulation control signal and the reference voltage signal. Specifically, the first control unit 201 has a reference voltage input end V_ref, a pulse width modulation control signal input end V_Ctrl, and a first voltage output end O1. The first control unit 201 comprises a first thin film transistor (TFT) T1, a first capacitor C1, and a resistor R. A first end of the first TFT T1 is connected to the reference voltage input end V_ref, and a second end of the first TFT T1 is connected to the first voltage output end O1, and a control end of the first TFT T1 is connected to the pulse width modulation control signal input end V_Ctrl. One end of the first capacitor C1 is connected to the first voltage output end O1, and the other end of the first capacitor C1 is connected to a ground end. One end of a resistor R is connected to the first voltage output end O1, and the other end of the resistor R is connected to the ground end.

The second control unit 202 is configured to output a second voltage according to the pulse width modulation scan signal and the pulse width modulation data signal. Specifically, the second control unit 202 comprises a pulse width modulation scan signal input end G_pwm, a pulse width modulation data signal input end D_pwm, and a second voltage output end O2. The second control unit 202 comprises a second TFT T2. A first end of the second TFT T2 is connected to the pulse width modulation data signal input end D_pwm, a second end of the second TFT T2 is connected to the second voltage output end O2, and a control end of the second TFT T2 is connected to the pulse width modulation scan signal input end G_pwm.

The comparison unit 203 is used to compare the first voltage and the second voltage to output a light-emitting duration control signal. The comparison unit 203 is connected to a first level output end O1, a second level output end O2, the ground end, and a light-emitting duration control signal output end O3. The comparison unit 203 comprises a voltage comparator 2031 and a second capacitor C2. A negative input end of the voltage comparator 2031 is connected to the first level output end O1, and a positive input end of the voltage comparator 2031 is connected to the second level output end O2. An output end of the voltage comparator 2031 is connected to the light-emitting duration control signal output end O3, one end of the second capacitor C2 is connected to the second level output end O2, and the other end of the second capacitor C2 is connected to the ground end.

The pulse amplitude modulation unit 30 is configured to control the amount of the driving current of the light-emitting element 50 according to the pulse amplitude modulation scan signal and the pulse amplitude modulation data signal. The pulse amplitude modulation unit 30 is configured to output an amplitude control signal according to the pulse amplitude modulation scan signal and the pulse amplitude modulation data signal. Specifically, the pulse amplitude modulation unit 30 comprises a pulse amplitude modulation scan signal input end G_pam, a pulse amplitude modulation data signal input end D_pam, and an amplitude control signal output end O4. The pulse amplitude modulation unit 30 comprises a fourth TFT T4, a first end of the fourth TFT T4 is connected to the pulse amplitude modulation data signal input end D_pam, a second end of the fourth TFT T4 is connected to the amplitude control signal output end O4, and a control end of the fourth TFT T4 is connected to the pulse amplitude modulation scan signal input end G_pam.

The driving unit 40 is configured to control the amount of the driving current of the light-emitting element 50 according to the amplitude control signal, and control the light-emitting duration of the light-emitting element 50 according to the light-emitting duration control signal. The driving unit 40 comprises a third TFT T3, a driving transistor Td, and a third capacitor C3. A control end of the third TFT T3 is connected to the light-emitting duration control signal output end O3, a first end of the third TFT T3 is connected to the ground end, a second end of the third TFT T3 is connected to a control end of the driving transistor Td, one end of the third capacitor C3 is connected to the control end of the driving transistor Td, and the other end of the third capacitor C3 is connected to a second end of the driving transistor Td. A first end of the driving transistor Td is connected to a first end of the light-emitting element 50, the second end of the driving transistor Td is connected to a second level end, and the second end of the light-emitting element 50 is connected to a first level end VDD. The second level end is the ground end.

Figure 5B:
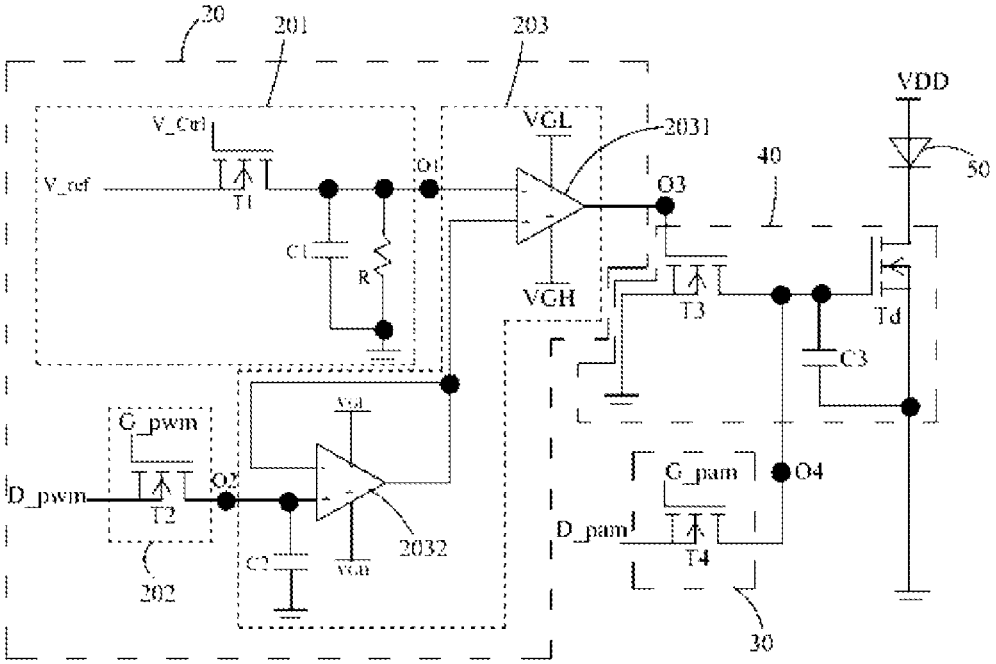
FIG. 5B is a second schematic diagram of the sub-pixel in FIG. 3.

Please refer to FIG. 5B, which is a second schematic diagram of the sub-pixel in FIG. 3. The sub-pixel shown in FIG. 5B is basically similar to the sub-pixel shown in FIG. 5A, except that the comparison unit 203 of the sub-pixel shown in FIG. 5B further comprises a voltage follower 2032. A positive input end of the voltage follower 2032 is connected to the second level output end, a negative input end and an output end of the voltage follower 2032 are connected to the positive input end of the voltage comparator 2031, and the negative input end of the voltage follower 2032 is connected to the output end of the voltage follower 2032. By arranging a voltage follower 2032 between the second level output end and the second input end of the voltage comparator 2031, signals of the pulse width modulation data signal input end D_pwm can be better maintained.

Figure 6:
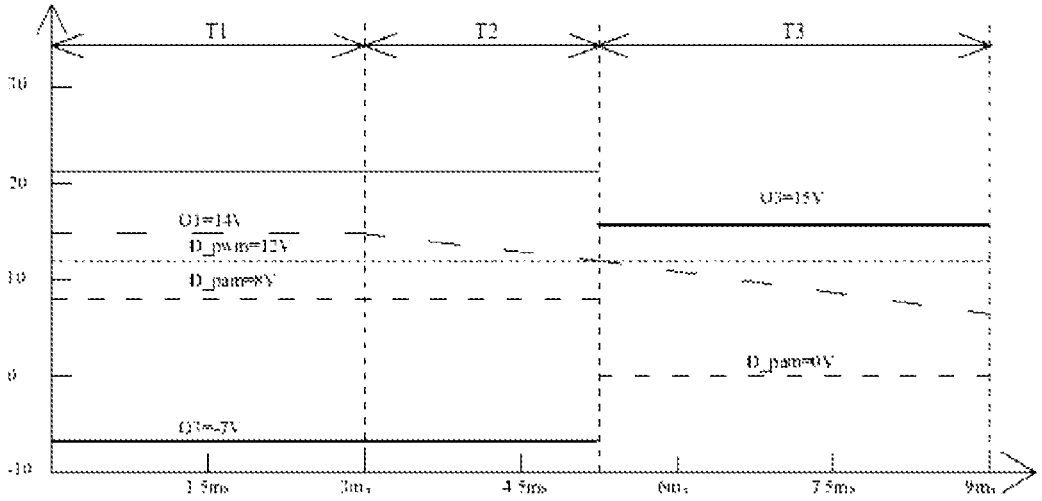
FIG. 6 is a driving timing diagram of the sub-pixel shown in FIG. 5A.

Please refer to FIG. 6, which is a driving timing diagram of the sub-pixel shown in FIG. 5A. A driving process of the sub-pixel shown in FIG. 5A includes a first time period, a second time period, and a third time period.

In the first time period, in the first control unit 201, the pulse width modulation control signal input end V_Ctrl receives the pulse width modulation control signal as a constant voltage, the first TFT T1 is turned on, the reference voltage input end V_ref receives a reference voltage, and the reference voltage is written to the first capacitor C1, the first capacitor C1 is charged, and the first voltage output from the first voltage output end O1 is 14V. In the second control unit 202, the pulse width modulation scan signal input end G_pwm receives the pulse width modulation scan signal, the second TFT T2 is turned on, and the pulse width modulation data signal input end D_pwm writes the second voltage to the second voltage output end O2, the second voltage is the pulse width modulation data signal, and the second voltage is 12V. In the comparison unit 203, the second voltage is written to the second capacitor C2, the second capacitor C2 is charged, the voltage comparator 2031 compares the first voltage and the second voltage, the first voltage is greater than the second voltage, the voltage comparator 2031 outputs a low voltage signal VGL, and the low voltage signal VGL is −7V. The low voltage signal VGL is written to the control end of the third TFT T3, and the third TFT is turned off. The pulse amplitude modulation scan signal is written to the control end of the fourth TFT T4, the fourth TFT T4 is turned on, the pulse amplitude modulation data signal is written to the amplitude control signal output end O4, the pulse amplitude modulation data signal is 8V, and the pulse amplitude modulation data signal is written to the third capacitor C3, the driving transistor Td is turned on, the first level end VDD receives a high-level DC signal, and the light-emitting element 50 starts to emit light. The first time period is 3 ms.

In the second time period, in the first control unit 201, the pulse width modulation control signal input end V_Ctrl receives the pulse width modulation control signal as a linear falling voltage, the first TFT T1 is turned off, the first capacitor C1 starts to discharge, and the first voltage output from the first voltage output end O1 decreases linearly from 14V to 12V. In the second control unit 202, the second voltage output from the second voltage output end O2 is continuously 12V. In the comparison unit 203, the first voltage is greater than the second voltage, and the voltage comparator 2031 continuously outputting the low voltage signal VGL. The low voltage signal VGL is written to the control end of the third TFT T3, and the third TFT T3 is still turned off. The pulse amplitude modulation scan signal is continuously written to the control end of the fourth TFT T4, the fourth TFT T4 is turned on, the pulse amplitude modulation data signal is written to the amplitude control signal output end O4, the pulse amplitude modulation data signal is 8V, and the driving transistor Td is continuously on, the first level end VDD continuously receiving the high-level DC signal, and the light-emitting element 50 continuously emitting light. The second time period is 2 ms.

In the third time period, in the first control unit 201, the pulse width modulation control signal received by the pulse width modulation control signal input end V_Ctrl is still a linear falling voltage, the first TFT T1 is turned off, the first capacitor C1 continuously discharges, and the first voltage output from the first voltage output end O1 linearly decreases from 12V to 8V. In the second control unit 202, the second voltage output from the second voltage output end O2 is continuously 12V. In the comparison unit 203, the first voltage is less than the second voltage. The voltage comparator 2031 continuously outputs a high voltage signal VGH, and the high voltage signal VGH is 15V. The high voltage signal VGH is written to the control end of the third TFT T3, the third TFT T3 is turned on, the pulse amplitude modulation data signal is 0V, the third capacitor C3 starts to discharge until the driving transistor Td is turned off, and the light-emitting element 50 is turned off.

In the first time period and the second time period, the current of the light-emitting element 50 depends on the pulse amplitude modulation data signal. When the pulse amplitude modulation data signal is strong enough, it solves a spectral shift problem when the light-emitting element is an inorganic light-emitting diode. In the third time period, the light-emitting duration of the light-emitting element 50 depends on a duration of the light-emitting duration control signal. The voltage comparator 2031 converts the pulse width modulation data signals of different magnitudes into different light-emitting durations of the light-emitting element 50, so that different grayscale levels can be generated.

Figure 7:
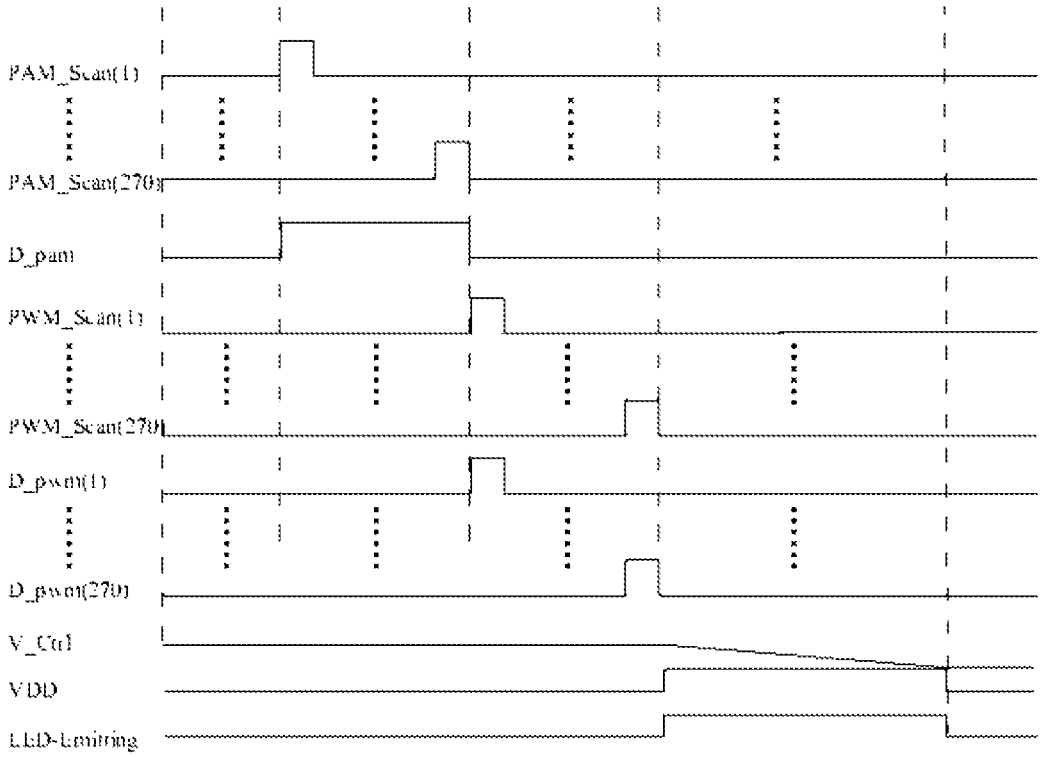
FIG. 7 is a driving timing diagram of the display device shown in FIG. 3.

Please refer to FIG. 7, which is a driving timing diagram of the display device shown in FIG. 3. Driving the display device comprises an initialization phase, a PWM input time period, a PAM input time period, and a light-emitting time period. A refresh rate of the display device is 120 HZ, and a resolution is 480*RGB*270.

At an initialization node, the pixel circuit of the display device is initialized, and at this point, the third TFT T3 is turned off.

During the PWM input time period, the first gate driving units 101 output a pulse width modulation scan signal to the first scan lines PWM_Scan to scan the sub-pixels row by row, and the first source driving unit writes the pulse width modulation data signal row by row to the second capacitors C2. The pulse width modulation control signal input end V_Ctrl outputs a constant voltage, and the first TFT T1 is turned on. The first level end VDD outputs a low level.

During the PAM input time period, the second gate driving units 102 output a pulse amplitude modulation scan signal to scan the sub-pixels row by row, and the second source driving unit 102 writes the pulse amplitude modulation data signal row by row and store it in the third capacitor C3. The pulse width modulation control signal input end V_Ctrl outputs a constant voltage, and the first TFT T1 is turned on. The first level end VDD outputs a low level.

During the light-emitting time period, the first level end VDD outputs a high level, the driving transistor Td is turned on, and all the light-emitting elements 50 emit light. The pulse width modulation control signal input end V_Ctrl outputs a linear falling voltage, and the first TFT T1 is turned off. The voltage comparator 2031 converts different pulse width modulation data signals of different sub-pixels into an ON time of the third TFT T3. After the third TFT T3 is turned on, electric charges in the third capacitor C3 are gradually released until the driving transistor Td is turned off, and the light-emitting element (LED) 50 stop emitting light. A total duration of light emission of each light-emitting element 50 is related to the magnitude of the pulse width modulation data signal, resulting in different brightness.

Figure 8:
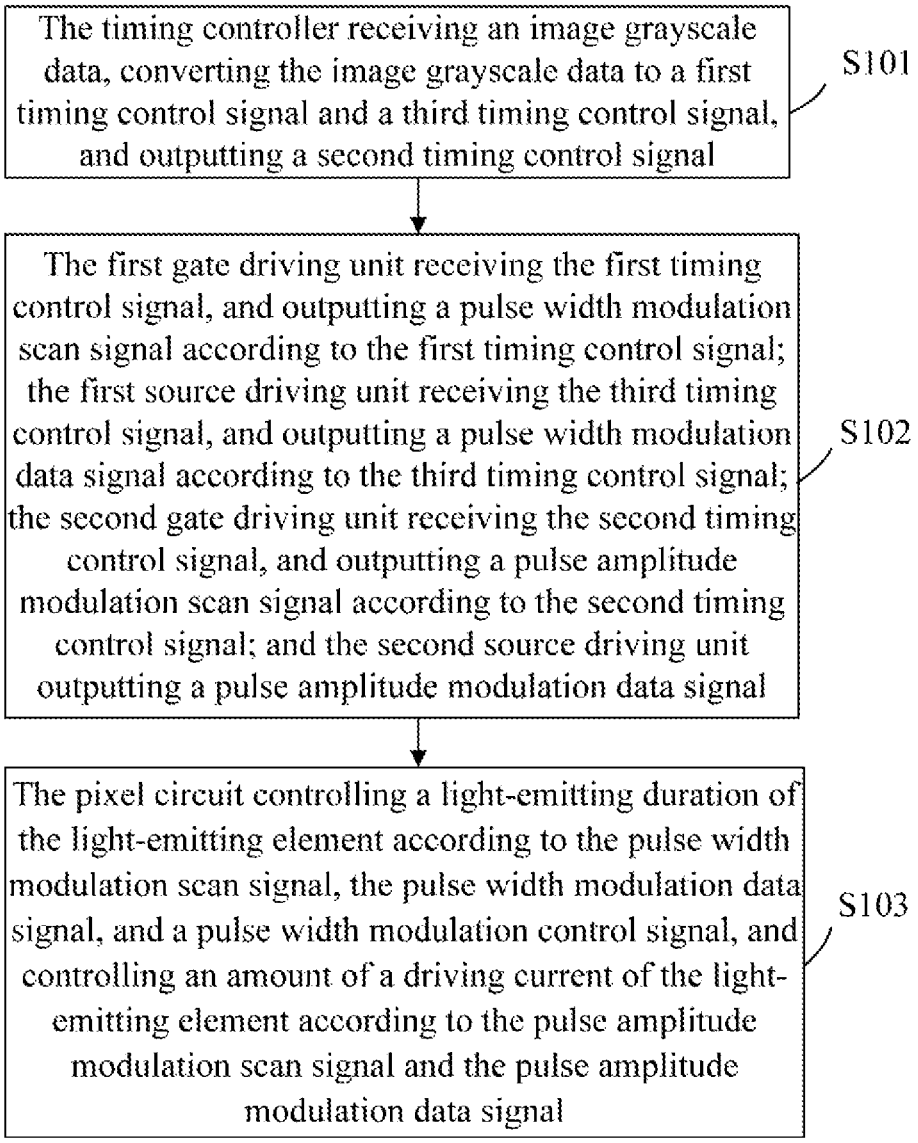
FIG. 8 is a schematic process flow diagram illustrating a driving method of the display device according to the present application.

The present application further provides a driving method of a display device. FIG. 8 is a process flow diagram of the driving method of the display device of the present application. The display device comprises a timing controller, a plurality of first gate driving units, a plurality of second gate driving units, a first source driving unit, a second source driving unit, and a display panel. The display panel comprises a plurality of sub-pixels, and each of the sub-pixels comprises a pixel circuit and a light-emitting element electrically connected to the pixel circuit; the timing controller is electrically connected to the first gate driving units, the second gate driving units, and the first source driving unit; and the first gate driving units, the second gate driving units, the first source driving unit, and the second source driving unit are electrically connected to the pixel circuits, wherein the driving method comprises following steps:

Step S101: the timing controller receiving an image grayscale data, converting the image grayscale data to a first timing control signal and a third timing control signal, and outputting a second timing control signal;

Step S102: the first gate driving unit receiving the first timing control signal, and outputting a pulse width modulation scan signal according to the first timing control signal; the first source driving unit receiving the third timing control signal, and outputting a pulse width modulation data signal according to the third timing control signal; the second gate driving unit receiving the second timing control signal, and outputting a pulse amplitude modulation scan signal according to the second timing control signal; and the second source driving unit outputting a pulse amplitude modulation data signal; and Step S103: the pixel circuit controlling a light-emitting duration of the light-emitting element according to the pulse width modulation scan signal, the pulse width modulation data signal, and a pulse width modulation control signal, and controlling an amount of a driving current of the light-emitting element according to the pulse amplitude modulation scan signal and the pulse amplitude modulation data signal.

The descriptions of the above embodiments are only used to ease understanding the technical solutions and main ideas of the present application. Those of ordinary skill in the art should understand that they can still modify the technical solutions described in the foregoing embodiments or equivalently replace some of the technical features, and these modifications or replacements are deemed to be within the protection scope of the present application.

What is claimed is:

1. A display device, comprising:

a timing controller, a plurality of first gate driving units, a plurality of second gate driving units, a first source driving unit, a second source driving unit, and a display panel, wherein the display panel comprises a plurality of sub-pixels, and each of the sub-pixels comprises a pixel circuit and a light-emitting element electrically connected to the pixel circuit, wherein the timing controller is electrically connected to the first gate driving units, the second gate driving units, and the first source driving unit, the timing controller is configured to receive an image grayscale data and convert the image grayscale data to a first timing control signal and a third timing control signal and is also configured to output a second timing control signal, and the timing controller further comprises a first conversion unit, a second conversion unit, and a third conversion unit;

the first conversion unit is configured to receive the image grayscale data and convert the image grayscale data into a brightness data according to a stored data relating to a mapping relationship between grayscale and brightness;

the second conversion unit is configured to receive the brightness data and convert the brightness data into a light-emitting time data according to a stored data relating to a mapping relationship between brightness and light-emitting time;

the third conversion unit is configured to receive the light-emitting time data and convert the light-emitting time data into the first timing control signal and the third timing control signal;

the first gate driving units are electrically connected to the pixel circuits, configured to receive the first timing control signal, and configured to output a pulse width modulation scan signal according to the first timing control signal;

the second gate driving units are electrically connected to the pixel circuits, configured to receive the second timing control signal, and configured to output a pulse amplitude modulation scan signal according to the second timing control signal;

the first source driving unit is electrically connected to the pixel circuits, configured to receive the third timing control signal, and configured to output the pulse width modulation data signal according to the third timing control signal;

the second source driving unit is electrically connected to the pixel circuits and configured to output a pulse amplitude modulation data signal; and the pixel circuit is configured to control a light-emitting duration of the light-emitting element according to the pulse width modulation scan signal, the pulse width modulation data signal, and a pulse width modulation control signal, and the pixel circuit is configured to control an amount of a driving current of the light-emitting element according to the pulse amplitude modulation scan signal and the pulse amplitude modulation data signal.

2. The display device according to claim 1, wherein the display panel comprises a plurality of first scan lines arranged parallel to each other along a first direction for transmitting the pulse width modulation scan signal, a plurality of second scan lines arranged parallel to each other along the first direction for transmitting the pulse amplitude modulation scan signal, a plurality of first data lines arranged parallel to each other along a second direction for transmitting the pulse width modulation data signal, at least one control signal line for transmitting the pulse width modulation control signal, and at least one second data line for transmitting the pulse amplitude modulation data signal;

the first gate driving units are electrically connected to the first scan lines, the second gate driving units are electrically connected to the second scan lines, the first source driving unit is connected to the first data lines, and the second source driving unit is electrically connected to the at least one second data line; and each of the sub-pixels is electrically connected to one of the first scan lines, one of the second scan lines, one of the first data lines, one of the at least one second data line, and one of the least one control signal line.

3. The display device according to claim 1, wherein the pixel circuit comprises a pulse width modulation unit and a pulse amplitude modulation unit;

the pulse width modulation unit is configured to control the light-emitting duration of the light-emitting element according to the pulse width modulation scan signal, the pulse width modulation data signal, and the pulse width modulation control signal; and the pulse amplitude modulation unit is configured to control the amount of the driving current of the light-emitting element according to the pulse amplitude modulation scan signal and the pulse amplitude modulation data signal.

4. The display device according to claim 3, wherein the pixel circuit further comprises a driving unit;

the pulse width modulation unit is configured to output a light-emitting duration control signal according to the pulse width modulation scan signal, the pulse width modulation data signal, and the pulse width modulation control signal;

the pulse amplitude modulation unit is configured to output an amplitude control signal according to the pulse amplitude modulation scan signal and the pulse amplitude modulation data signal; and the driving unit is configured to control the amount of the driving current of the light-emitting element according to the amplitude control signal and control the light-emitting duration of the light-emitting element according to the light-emitting duration control signal.

5. The display device according to claim 4, wherein the pulse width modulation unit comprises a first control unit, a comparison unit, and a second control unit;

the first control unit is configured to output a first voltage according to the pulse width modulation control signal and a reference voltage signal;

the second control unit is configured to output a second voltage according to the pulse width modulation scan signal and the pulse width modulation data signal; and the comparison unit is configured to compare the first voltage and the second voltage to output the light-emitting duration control signal.

6. The display device according to claim 5, wherein the first control unit has a reference voltage input end, a pulse width modulation control signal input end, and a first voltage output end, the first control unit comprises a first thin film transistor (TFT), a first capacitor, and a resistor; a first end of the first TFT is connected to the reference voltage input end, a second end of the first TFT is connected to the first voltage output end, and a control end of the first TFT is connected to the pulse width modulation control signal input end; one end of the first capacitor is connected to the first voltage output end, another end of the first capacitor is connected to a ground end, one end of the resistor is connected to the first voltage output end, and another end of the resistor is connected to the ground end;

the second control unit has a pulse width modulation scan signal input end, a pulse width modulation data signal input end, and a second voltage output end, the second control unit comprises a second TFT, a first end of the second TFT is connected to the pulse width modulation data signal input end, a second end of the second TFT is connected to the second voltage output end, and a control end of the second TFT is connected to the pulse width modulation scan signal input end; and the comparison unit is connected to a first level output end, a second level output end, the ground end, and a light-emitting duration control signal output end, the comparison unit comprises a voltage comparator and a second capacitor, a negative input end of the voltage comparator is connected to the first level output end, a positive input end of the voltage comparator is connected to the second level output end, an output end of the voltage comparator is connected to the light-emitting duration control signal output end, one end of the second capacitor is connected to the second level output end, and another end of the second capacitor is connected to the ground end.

7. The display device according to claim 6, wherein the comparison unit further comprises a voltage follower, a positive input end of the voltage follower is connected to the second level output end, a negative input end and an output end of the voltage follower are connected to the positive input end of the voltage comparator, and the negative input end of the voltage follower is connected to the output end of the voltage follower.

8. The display device according to claim 4, wherein the driving unit comprises a third TFT, a driving transistor, and a third capacitor, a control end of the third TFT is connected to a light-emitting duration control signal output end, a first end of the third TFT is connected to a ground end, a second end of the third TFT is connected to a control end of the driving transistor, one end of the third capacitor is connected to the control end of the driving transistor, and another end of the third capacitor is connected to a second end of the driving transistor, a first end of the driving transistor is connected to a first end of the light-emitting element, the second end of the driving transistor is connected to a second level end, a second end of the light-emitting element is connected to a first level end; and the pulse amplitude modulation unit comprises a fourth TFT, a first end of the fourth TFT is connected to a pulse amplitude modulation data signal input end, a second end of the fourth TFT is connected to an amplitude control signal output end, and a control end of the fourth TFT is connected to a pulse amplitude modulation scan signal input end.

9. A driving method of a display device, wherein the display device comprises a timing controller, a plurality of first gate driving units, a plurality of second gate driving units, a first source driving unit, a second source driving unit, and a display panel; the display panel comprises a plurality of sub-pixels, and each of the sub-pixels comprises a pixel circuit and a light-emitting element electrically connected to the pixel circuit; the timing controller is electrically connected to the first gate driving units, the second gate driving units, and the first source driving unit; and the first gate driving units, the second gate driving units, the first source driving unit, and the second source driving unit are electrically connected to the pixel circuits, wherein the driving method comprises following steps:

the timing controller receiving an image grayscale data, converting the image grayscale data to a first timing control signal and a third timing control signal, and outputting a second timing control signal, wherein the timing controller further comprises a first conversion unit, a second conversion unit, and a third conversion unit;

the first conversion unit is configured to receive the image grayscale data and convert the image grayscale data into a brightness data according to a stored data relating to a mapping relationship between grayscale and brightness;

the second conversion unit is configured to receive the brightness data and convert the brightness data into a light-emitting time data according to a stored data relating to a mapping relationship between brightness and light-emitting time;

the third conversion unit is configured to receive the light-emitting time data and convert the light-emitting time data into the first timing control signal and the third timing control signal;

the first gate driving unit receiving the first timing control signal and outputting a pulse width modulation scan signal according to the first timing control signal; the first source driving unit receiving the third timing control signal and outputting a pulse width modulation data signal according to the third timing control signal; the second gate driving unit receiving the second timing control signal and outputting a pulse amplitude modulation scan signal according to the second timing control signal; and the second source driving unit outputting a pulse amplitude modulation data signal; and the pixel circuit controlling a light-emitting duration of the light-emitting element according to the pulse width modulation scan signal, the pulse width modulation data signal, and a pulse width modulation control signal, and controlling an amount of a driving current of the light-emitting element according to the pulse amplitude modulation scan signal and the pulse amplitude modulation data signal.

10. The driving method of the display device according to claim 9, wherein the display panel comprises a plurality of first scan lines arranged parallel to each other along a first direction for transmitting the pulse width modulation scan signal, a plurality of second scan lines arranged parallel to each other along the first direction for the transmitting the pulse amplitude modulation scan signal, a plurality of first data lines arranged parallel to each other along a second direction for transmitting the pulse width modulation data signal, at least one control signal line for transmitting the pulse width modulation control signal, and at least one second data line for transmitting the pulse amplitude modulation data signal;

the first gate driving units are electrically connected to the first scan lines, the second gate driving units are electrically connected to the second scan lines, the first source driving unit is connected to the first data lines, and the second source driving unit is electrically connected to the at least one second data line; and each of the sub-pixels is electrically connected to one of the first scan lines, one of the second scan lines, one of the first data lines, one of the at least one second data line, and one of the at least one control signal line.

11. The driving method of the display device according to claim 9, wherein the pixel circuit comprises a pulse width modulation unit and a pulse amplitude modulation unit;

the pulse width modulation unit is configured to control the light-emitting duration of the light-emitting element according to the pulse width modulation scan signal, the pulse width modulation data signal, and the pulse width modulation control signal; and the pulse amplitude modulation unit is configured to control the amount of the driving current of the light-emitting element according to the pulse amplitude modulation scan signal and the pulse amplitude modulation data signal.

12. The driving method of the display device according to claim 11, wherein the pixel circuit further comprises a driving unit;

the pulse width modulation unit is configured to output a light-emitting duration control signal according to the pulse width modulation scan signal, the pulse width modulation data signal, and the pulse width modulation control signal;

the pulse amplitude modulation unit is configured to output an amplitude control signal according to the pulse amplitude modulation scan signal and the pulse amplitude modulation data signal; and the driving unit is configured to control the amount of the driving current of the light-emitting element according to the amplitude control signal and control the light-emitting duration of the light-emitting element according to the light-emitting duration control signal.

13. The driving method of the display device according to claim 12, wherein the pulse width modulation unit comprises a first control unit, a comparison unit, and a second control unit;

the first control unit is configured to output a first voltage according to the pulse width modulation control signal and a reference voltage signal;

the second control unit is configured to output a second voltage according to the pulse width modulation scan signal and the pulse width modulation data signal; and the comparison unit is configured to compare the first voltage and the second voltage to output the light-emitting duration control signal.

14. The driving method of the display device according to claim 13, wherein the first control unit has a reference voltage input end, a pulse width modulation control signal input end, and a first voltage output end; the first control unit comprises a first thin film transistor (TFT), a first capacitor, and a resistor; a first end of the first TFT is connected to the reference voltage input end, a second end of the first TFT is connected to the first voltage output end, a control end of the first TFT is connected to the pulse width modulation control signal input end, one end of the first capacitor is connected to the first voltage output end, another end of the first capacitor is connected to a ground end, one end of the resistor is connected to the first voltage output end, and another end of the resistor is connected to the ground end;

the second control unit comprises a pulse width modulation scan signal input end, a pulse width modulation data signal input end, and a second voltage output end, the second control unit comprises a second TFT, a first end of the second TFT is connected to the pulse width modulation data signal input end, a second end of the second TFT is connected to the second voltage output end, and a control end of the second TFT is connected to the pulse width modulation scan signal input end; and the comparison unit is connected to a first level output end, a second level output end, the ground end, and a light-emitting duration control signal output end, the comparison unit comprises a voltage comparator and a second capacitor, a negative input end of the voltage comparator is connected to the first level output end, a positive input end of the voltage comparator is connected to the second level output end, an output end of the voltage comparator is connected to the light-emitting duration control signal output end, one end of the second capacitor is connected to the second level output end, and another end of the second capacitor is connected to the ground end.

15. The driving method of the display device according to claim 14, wherein the comparison unit further comprises a voltage follower, a positive input end of the voltage follower is connected to the second level output end, a negative input end and an output end of the voltage follower are connected to the positive input end of the voltage comparator, and the negative input end of the voltage follower is connected to the output end of the voltage follower.

16. The driving method of the display device according to claim 12, wherein the driving unit comprises a third TFT, a driving transistor, and a third capacitor, a control end of the third TFT is connected to a light-emitting duration control signal output end, a first end of the third TFT is connected to a ground end, a second end of the third TFT is connected to a control end of the driving transistor, one end of the third capacitor is connected to the control end of the driving transistor, another end of the third capacitor is connected to a second end of the driving transistor, a first end of the driving transistor is connected to a first end of the light-emitting element, the second end of the driving transistor is connected to a second level end, a second end of the light-emitting element is connected to a first level end; and the pulse amplitude modulation unit comprises a fourth TFT, a first end of the fourth TFT is connected to a pulse amplitude modulation data signal input end, a second end of the fourth TFT is connected to an amplitude control signal output end, and a control end of the fourth TFT is connected to the pulse amplitude modulation scan signal input end.

* * * * *